United States Patent [19]

Guertin

[11] Patent Number: 4,509,299

[45] Date of Patent: Apr. 9, 1985

[54] MEANS FOR REFACING A FUEL NOZZLE AND METHOD THEREOF

[75] Inventor: Joseph R. Guertin, Bristol, Conn.

[73] Assignee: United Technologies Corporation, Hartford, Conn.

[21] Appl. No.: 424,666

[22] Filed: Sep. 27, 1982

[51] Int. Cl.[3] ..... B25B 5/00; B24B 19/00

[52] U.S. Cl. ..... 51/237 R; 51/225

[58] Field of Search ..... 51/237 R, 217 A, 217 R, 51/216 R, 216 ND, 216 H, 225; 269/60, 71, 189, 152, 104

[56] References Cited

U.S. PATENT DOCUMENTS

| | | | |
|---|---|---|---|
| 1,675,437 | 7/1928 | Waldron | 51/217 A |
| 1,725,578 | 8/1929 | Gulliford | 269/60 |
| 2,246,023 | 6/1941 | Spurling | 51/217 A |
| 2,988,354 | 6/1961 | Schultz | 269/60 |

*Primary Examiner*—James G. Smith

*Attorney, Agent, or Firm*—Norman Friedland

[57] ABSTRACT

Apparatus and method for refacing the face of a fuel nozzle to be replaced in the combustor of a gas turbine engine by a grinding operation that synchronously rotates the face in a given plane relative to the plane of the grinding wheel. Means are provided for locating the plane of the face in a given spatial plane relative to the pitch diameter of the threads formed on the nozzle body surrounding the face.

3 Claims, 2 Drawing Figures

MEANS FOR REFACING A FUEL NOZZLE AND METHOD THEREOF

TECHNICAL FIELD

This invention relates to fuel nozzles for a gas turbine engine and more particularly to apparatus for refurbishing the face of the nozzle so that it can be reused in the engine.

BACKGROUND ART

One of the maintenance problems associated with fuel nozzles is the scratching of its face occasioned by the face seal that prevents leakage of fuel and an escapement of flames from the engine's combustor. This scratching would otherwise prevent the reuse of the fuel nozzle. Heretofore the face was reworked by what is considered in today's standards a tedious, time-consuming procedure.

The heretofore solution was to remove the fuel nozzle and insert it into a fixture that was adapted to fit onto a grinding machine that included a fixed grinding wheel and a movable table. The fixture was locked onto the table and was shimmied in order to present the face of the nozzle in a horizontal position relative to the tangent at the point where the grinding wheel touched the face of the nozzle. The intent was to grind the face so that it would be substantially parallel to the diametrical pitch of the threaded portion of the nozzle that surrounded the face. Obviously, since the planes of the face were in spatial relationship and the shimming was a trial and error procedure, the set up of the fixture was a time-consuming task.

Because the grinding heretofore was done in a horizontal direction by passing the grinding wheel over a portion of the face in a rectilinear motion while traversing the grinding wheel until the entire face was finished, the face had to be lap finished. This necessitated removing the nozzle from the grinding machine so that a hand lapper could be employed to perform the lapping operation. Typically, this was performed by another operator in another department. The lapping machine was a hand-held device with a rotating wheel rotated by the operator that through a camming device imparted an oscillating motion to the spindle. A small replaceable and expendable disk shaped emery cloth was mounted on the end of the spindle adapted to bear against the face of the nozzle. The lapping operation was extremely time-consuming before the required finish on the face was realized.

I have found that I can obviate the cumbersome procedure noted in the above by providing a rotatable fixture having indexing means to square the face relative to the pitch diameter of the nozzle's threads. The fixture is adapted to fit on the same grinding machine that was heretofore utilized but the indexing and grinding operation eliminated the shimming and lapping operation. Because the grinding provided an acceptable finish thereby eliminating the lapping operation, the same results were achieved in a single operation rather than the two heretofore required. I have found that not only is there a substantial economical savings because of the invention, the time for reworking the face was reduced by twelve times. A typical time to rework a piece by the heretofore method was 6.5 hours as compared to 0.5 hours with the use of this invention.

DISCLOSURE OF INVENTION

An object of this invention is to provide apparatus to reface the face of a fuel nozzle for a gas turbine engine that provides the fuel to the engine's combustion so that it can be reused which apparatus is characterized as being more economical to use and eliminates a step in the heretofore method of refacing.

A feature of this invention is to provide an adjustable fixture to hold the fuel nozzle so that its face bears a particular relationship to the pitch diameter of the nozzle's threads that surround said face. Another feature of the invention is to rotate the face about the face's centerline so that its direction of rotation is in a given relationship to the direction of the grinding wheel.

Other features and advantages will be apparent from the specification and claims and from the accompanying drawings which illustrate an embodiment of the invention.

BEST MODE FOR CARRYING OUT THE INVENTION

For the purposes of the description of the present invention the face of the fuel nozzle is that surface that is inserted into the combustor whether it be a can, coannular or annular type, that sees the flames in the combustion zone. It is customary to insert it into an opening in the combustor liner and capture it in place with a locking and seal assembly. This assembly serves to hold the nozzle rigidly in place and prevent either fuel or flames from leaking rearwardly outside of the confines of the combustor.

Figure 1:
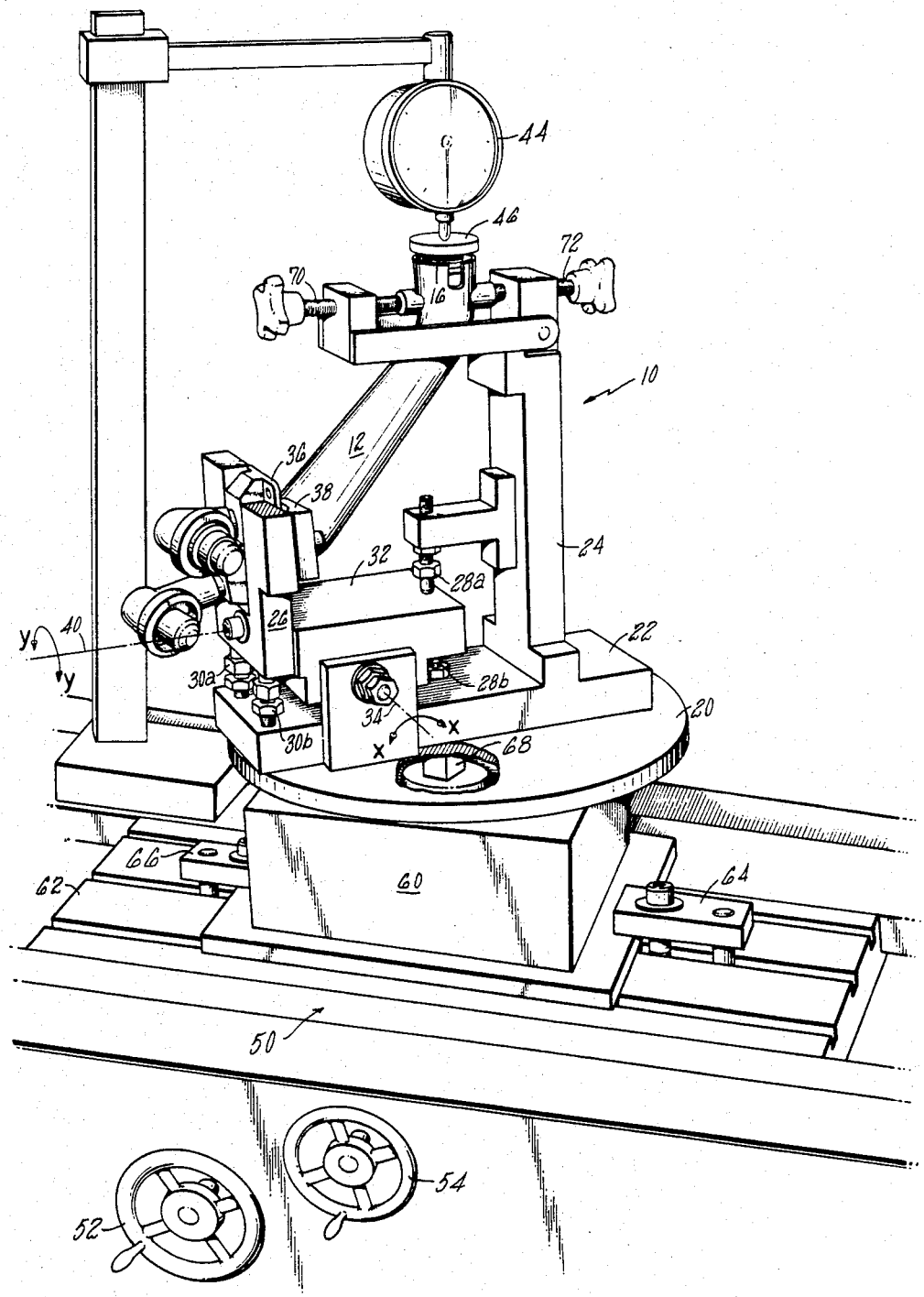
FIG. 1 is a fragmentary perspective view partly in schematic illustrating the details of this invention showing the face while being squared relative to the pitch diameter of the threads.
Figure 2:
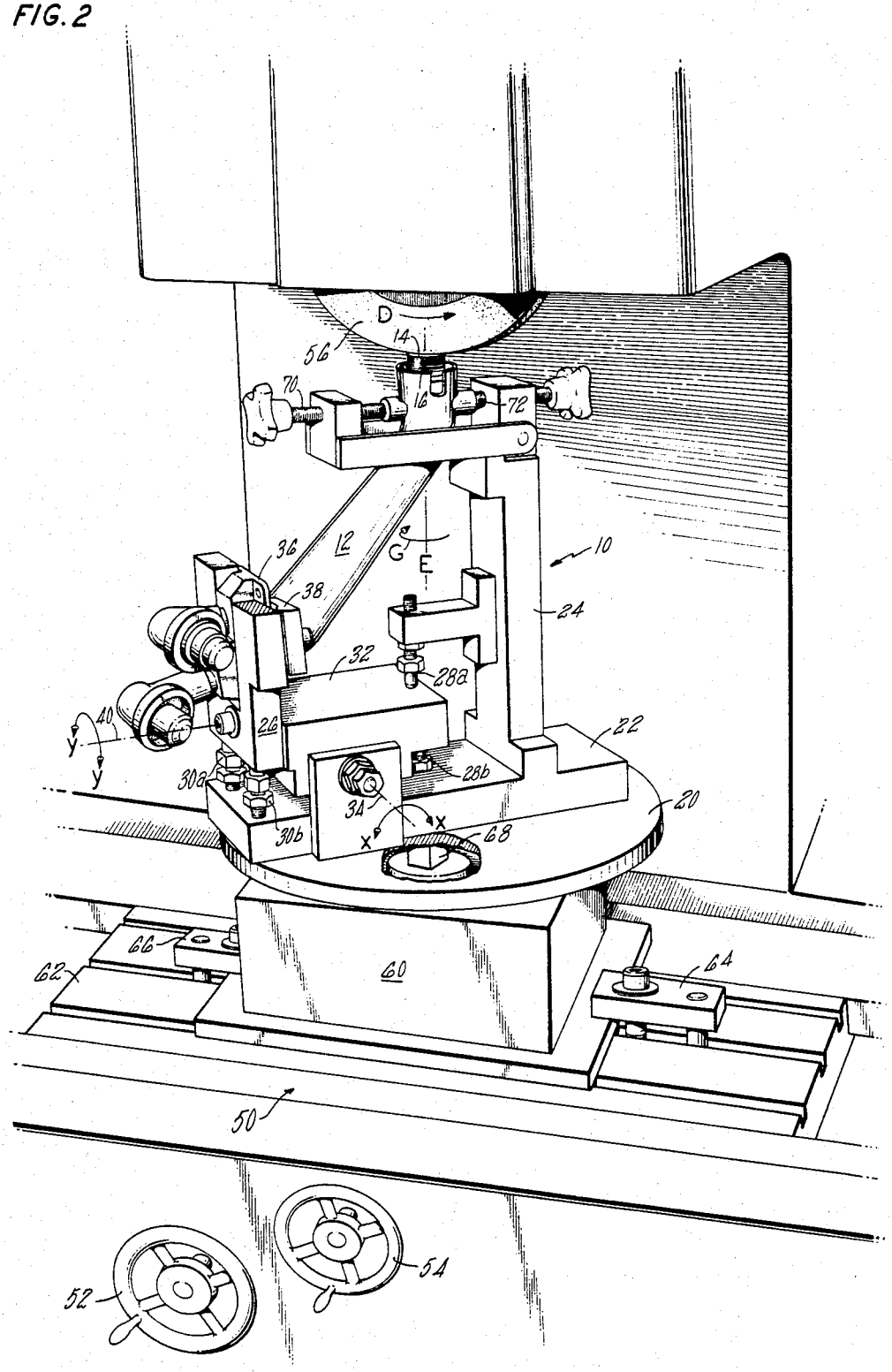
FIG. 2 is substantially the same view as in FIG. 1 where the squaring cap is removed and the face is placed in the grinding position.

Referring now to FIGS. 1 and 2, the fixture generally indicated by reference numeral 10 serves to hold fuel nozzle 12 so that its face 14 is in spatial relationship and oriented so that it is squared with relation to the pitch diameter of the threads 16. Fixture 10 comprises a base 20 supporting base block 22. A pair of axially spaced upstanding members 24 and 26 and the associated stop members 28*a* and 28*b* and 30*a* and 30*b* serves to adjust the spatial relationship by allowing members 26 and 32 to be pivotable about support axis 40 and 34 respectively for adjusting the x—x and y—y axes (not shown) of the face 14 as will be described hereinbelow.

As is apparent from the foregoing, the member 26 is bifurcated and receives the flanged end of the fuel nozzle 12. This flange 36 is clamped by clamping members 38 (one being shown) which secures the base of the nozzle 12 against upstanding member 26. Upstanding member 26 is pivotally supported about support axes 40. This member 26 rotates about pivot 40 providing the y—y axes (as shown) and member 32 pivots about pivot 34 providing the x—x axes (as shown). The adjustable stops are 28*a* and 28*b* and 30*a* and 38*b* which are adjustable synchronously to provide the proper indexing of face 14. As shown, the dial indicator gage 44 is utilized in connection with the squaring cap 46 to determine the squareness of face 14. Obviously, squaring cap 46 fits the threads portion 16 of the fuel nozzle and the top surface places it in relationship with the pitch diameter. When the top surface of cap 46 is properly oriented in the x—x and y—y axes the face is squared relative to the pitch diameter of the threads and it is ready to be grinded.

The fixture is then moved into the grinding position as shown in FIG. 2. As noted, the fixture is supported to a lathe type carriage 50 having longitudinal movement by rotating handle 52 and lateral movement by rotating handle 54. The details of the lathe bed and its operation are omitted herefrom for the sake of convenience and clarity recognizing that any typical commercially available lathe or grinding machine may be utilized. It only being necessary to note that the table gives proper support to the fixture and allows the operator to move the workpiece relative to the grinding wheel 56.

The grinding wheel 56 is a suitable commercially available abrasive wheel and the peripheral edge is used to grind the face 14. Grinding wheel 56 in the embodiment shown in FIGS. 1 and 2 rotates in the direction as shown by arrow D at a relatively high speed.

FIX. 10 is supported by the driving mechanism generally indicated by reference numeral 60 which is clamped to the ways 62 of carriage 50 by clamps 64 and 66. Driving mechanism 60 comprises a suitable electric motor that carries a rotatable shaft that receives spline 68 rigidly secured to base 20.

Hence, as is apparent from the foregoing the fixture 10 is rotated at a relatively low speed as compared with the speed of grinding wheel 56 so that face 14 rotates about the centerline E in the direction shown by arrow G which is coincidental with the centerline of the fuel ejecting orifice (not shown) that lies in the center of face 14. The face 14 can be moved laterally with respect to the wheel 56 to completely grind face 14. The combined effect of the rotating grinding wheel and rotating face 14 of fuel nozzle 12 provides a finish that is suitable for reuse in the engine.

To date, because of the squaring procedure, there has been no incidence reported where leakage has occurred because of an untrue dimensioned face caused by this grinding procedure.

The screw members 70 and 72 can be used to stabilize the end of fuel nozzle 12 to assure the nozzle does not move because of vibrations. Obviously, it is contemplated that the exact dimensions and details of the fixture are adapted to secure the particular nozzle being refurbished. Typically the shapes and sizes of fuel nozzles for different engines are different.

It should be understood that the invention is not limited to the particular embodiments shown and described herein, but that various changes and modifications may be made without departing from the spirit and scope of this novel concept as defined by the following claims.

I claim:

1. In combination, apparatus for refacing the face of a fuel nozzle that has a threaded section that is to be replaced in a gas turbine engine, and a gage for orienting the face in a given spatial orientation, a retractable cap having a flat top surface threadably engaging said threaded section, said fuel nozzle having a central axis comprising a base for being supported in a grinding machine adapted to move the base longitudinally and laterall, an upstanding support member for supporting said fuel nozzle for placing said face in position for being grinded by the grinding wheel of said grinding machine, a horizontal support member having a pivot pivotally supporting it to said base for being adjusted in a first plane so that said gage bears against said surface so that said face is oriented in spatial relationship to be square with respect to the pitch diameter of threads formed on said nozzle; said horizontal member pivotally supporting said upstanding support member so that said gage bears against said surface to orient said face in a second plane that is transverse to said first plane to square said face relative to the pitch diameter of said threads, and means for imparting rotary motion to said base so that said face rotates about its central axis at a relative slow rate of speed relative to the rate of speed of said grinding wheel in a direction that is opposite relative to the direction of rotation of said grinding wheel upon removal of said gage and said cap.

2. Apparatus as in claim 1 including a first pair of adjustable lock screws mounted on each side of said pivot of said horizontal support member for adjusting the angular position thereof and a second pair of adjustable lock screws mounted on each side of said pivot of said upstanding support member for adjusting the angular position thereof whereby the spatial plane of said face is locked in a given position.

3. Apparatus as in claim 2 including a second upstanding support member supported to said base with retractable locking arms spaced remote from said base and adjacent said face for preventing said face from moving due to the vibration created by said grinding machine.

* * * * *